US005460289A

United States Patent [19]

Gemmell

[11] Patent Number: 5,460,289

[45] Date of Patent: Oct. 24, 1995

[54] PAINT TRAY ASSEMBLY WITH DISPOSABLE MULTI-LAYERED LINER

[76] Inventor: Wayne R. Gemmell, 2520 Pasqua St., Regina, Saskatchewan, Canada, S4S 0M2

[21] Appl. No.: 135,537

[22] Filed: Oct. 14, 1993

[51] Int. Cl.[6] ..... B65D 25/16

[52] U.S. Cl. ..... 220/406; 220/407; 220/410

[58] Field of Search ..... 220/406, 407, 220/570, 23.83, 326, 408, 410, 403, 404

[56] References Cited

U.S. PATENT DOCUMENTS

| | | | |
|---|---|---|---|
| 1,912,860 | 6/1933 | Ranhofer | 220/406 |
| 2,542,413 | 2/1951 | Ibsch, Jr. | 220/406 |
| 2,887,705 | 5/1959 | Serwer | 220/570 |
| 2,947,441 | 8/1960 | Brannan | 220/406 |
| 3,512,338 | 5/1970 | Nestler | 220/407 |
| 3,800,503 | 4/1974 | Maki | 220/407 |
| 4,344,646 | 8/1982 | Michel | 220/326 |
| 4,547,926 | 10/1985 | Kern | 220/570 |
| 4,574,776 | 3/1986 | Hilde | 220/23.83 |
| 5,301,829 | 4/1994 | Chrisco | 220/326 |
| 5,337,913 | 8/1994 | Fukuda | 220/326 |

FOREIGN PATENT DOCUMENTS

| | | | |
|---|---|---|---|
| 1271791 | 4/1972 | United Kingdom | 220/407 |

*Primary Examiner*—Stephen J. Castellano

[57] ABSTRACT

A unique assembly is provided having a supporting base. Mounted on or integrally joined to the base is a supporting tray which carries a unitary strippable liner package formed of several tray shaped and separately disposable liquid-impermeable liners, preferably 3–10 mils in thickness, for containing the liquid. The several liners are each easily grasped by the upper liners extending beyond the lower liners. The unitary liner package is held in place by retainer pins and clamped down by an overflow dam. The overflow dam has a pressure edge to seal against the liner package, a grasping ledge to lift it off of the liner package and a rough or uneven surface engaging a similar surface on the supporting tray to ensure continuous clamping pressure. A support rod can be placed transversly in a recess in the overflow dam when coating implements are to be stored in the supporting tray. The assembly has an airtight cover with carrying handle which is fastened to the base by a hook at one end and biased hook fasteners at the other end. A storage tray can be clamped to the underside of the base for convenience.

19 Claims, 6 Drawing Sheets

PAINT TRAY ASSEMBLY WITH DISPOSABLE MULTI-LAYERED LINER

FIELD OF INVENTION

This application relates to liquid coating equipment and more particularly to an equipment combination that is used to provide a supply of liquid for application and a container for its storage.

BACKGROUND OF INVENTION

In an attempt to make objects or structures more pleasing to the eye or to protect them from the elements various types of surfaces have been applied in various ways. One common solution to the age old problem is the application of a coating of paint by a spray, roller, brush or other means. Some problems that always arise with painting is that paint invariably ends up coating the equipment as well as the object intended to be coated and that the paint dries quickly often ruining expensive brushes, sleeve rollers or the paint itself. To obviate the problems to a considerable degree there is herein described a combination that will seal or cover the tray with paint for an extended period of time,that will permit transportation of the tray with paint, and make available a package of disposable new paint receiving liners for a selection of a new one as required. While several types of paint trays and single liners are on the market and described in prior art, there are none known to applicant that come close to solving the above mentioned problems in the manner described in this application.

SUMMARY OF INVENTION

The present invention provides a novel and unique assembly to be used by a novice of commercial craftsman in the application of a liquid coating material. The assembly includes a base with retractable legs for supporting the assembly in an upright position. Mounted on or integrally joined to the base is a tray which has placed therein a unitary liner package which is formed of several tray shaped and separately disposable liquid-impermeable layers preferably 3–10 mils in thickness, for containing the liquid. The several layers are each easily grasped for disposal by the upper layers extending beyond the lower layers. The unitary liner package is held in place by aligning retainer pins and clamped down by an overflow dam. The overflow dam has a pressure edge to seal against the liner package, a grasping ledge to lift it off of the liner package and a rough of uneven surface engaging the tray to ensure continuous clamping pressure. A support rod can be placed in a recess in the overflow dam when coating implements are to be stored in the tray. The assembly has an airtight cover with a carrying handle which is fastened to the base by a hook at one end and biased hook fasteners at the other end. A storage tray can be clamped to the underside of the base for convenience.

In view of the above summary it is readily discernible that a primary object of the present invention is to provide a system or assembly that is convenient and avoids financial loss due to damaged coating material plus coating implements especially when the coating material is fast drying.

A further object of this invention is to provide a unitary package of shaped impermeable layers or liners that can contain a liquid and are easily removed presenting a fresh new and clean containing surface.

A further object of this invention is to provide an air sealed chamber that will keep a fast drying liquid such as paint fresh for an extended period of time.

A further object of this invention is to provide a dam to prevent a fast drying coating liquid from slopping over and sealing the edges of the unitary liner package and to hold the package firmly in place.

It is yet a further object of this invention to provide an implement or liquid applicator handle doubling as a carrier handle.

These and other objects of the present invention will become readily apparent as the following description is read in conjunction with the accompanying drawings wherein like reference numerals indicate like elements throughout the several views.

DETAILED DESCRIPTION OF THE INVENTION

Figure 1:
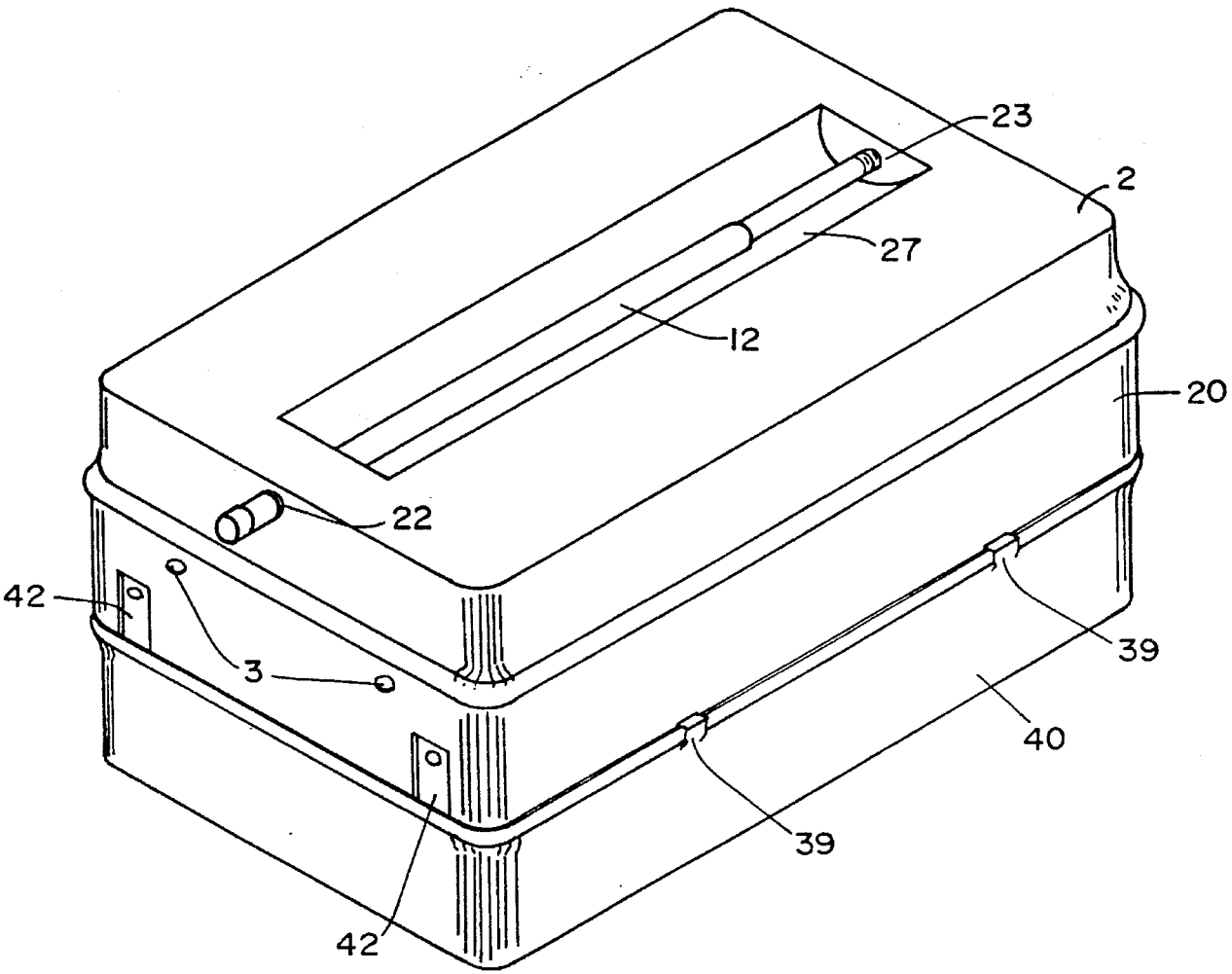
FIG. 1 is a perspective view of a complete paint tray as it would appear when ready for storage.
Figure 7:
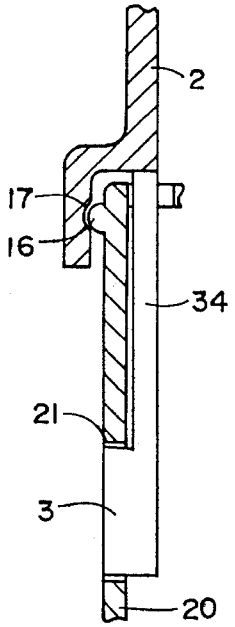
FIG. 7 is a partial vertical section of a first embodiment of a cover snap lock taken at the cutting plane VII—VII in FIG. 2.
Figure 8:
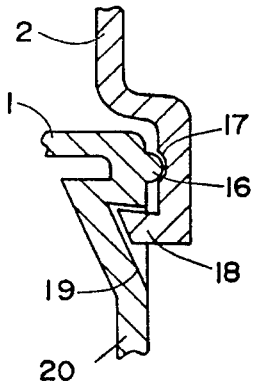
FIG. 8 is a partial vertical section of the cover and base hooking means taken at the cutting plane VIII—VIII in FIG. 2.
Figure 10:
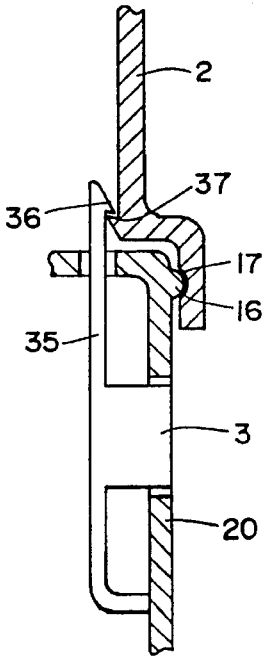
FIG. 10 is a partial vertical section of a second embodiment of a cover snap lock which would replace the type shown in FIG. 7.

Referring initially to FIG. 1 there is shown in perspective the closed complete assembly as it would appear ready for storage should it be necessary due to a short or long term interruption in use. The assembly has a generally flat bottom base 20 which easily slides along the floor etc. and provides considerable stability. The cover 2 has been placed in the storage position and is attached at the far end by a hook and recess as shown in FIG. 8 and by a biased snap lock at the near end, two embodiments of which are shown in FIGS. 7 and 10. The release buttons of both embodiments are here shown as release buttons 3 which are inherently biased by the material used in the cover 2 or base 20 as applicable. Any kind of biasing is possible. On the outside of cover 2 there is a handle recess 27 which receives a handle 12 supported at the far end by a threaded extension handle collar 23 and at the near end by a handle collar 22. Handle 12 can double as a tool or implement extension handle or as a carrying handle. A storage tray 40 is held below the bottom of base 20 by resilient clips 39 engaging tray clamp notches 46. Retractable legs 42 must be retracted when the storage tray 40 is in place.

Figure 2:
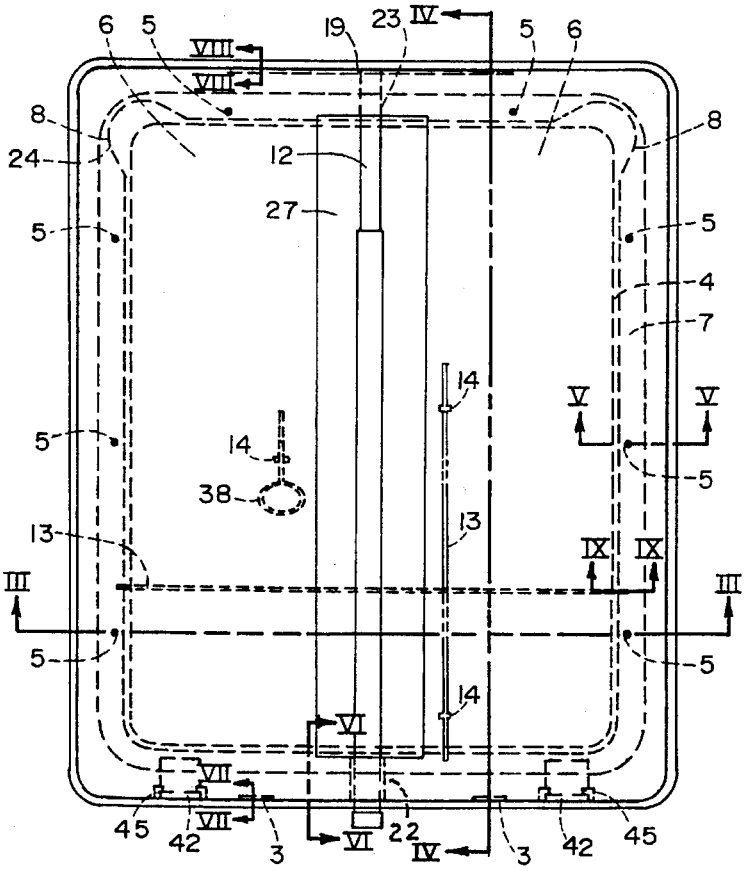
FIG. 2 is a plan view of FIG. 1 having no storage tray. The main elements are shown in hidden lines with several cutting planes taken to present the main features in more detail.

Now referring to FIG. 2 there is here shown a plan view of the assembly with the cover 2 in place but with the storage tray 40 removed. Several cutting planes have been shown and their relationship to the various figures is given in the above brief description of the drawings.

Figure 3:
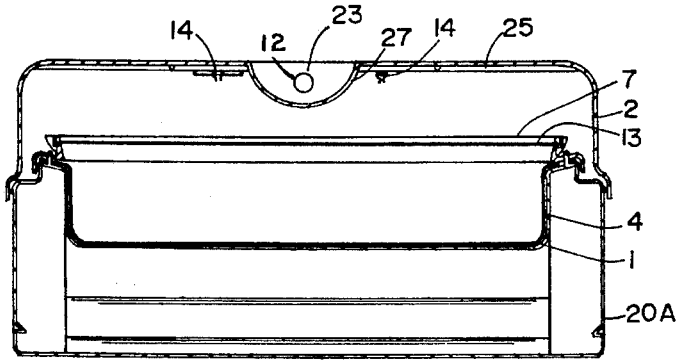
FIG. 3 is a partially sectioned view of the assembly taken at the cutting plane III—III in FIG. 2.
Figure 4:
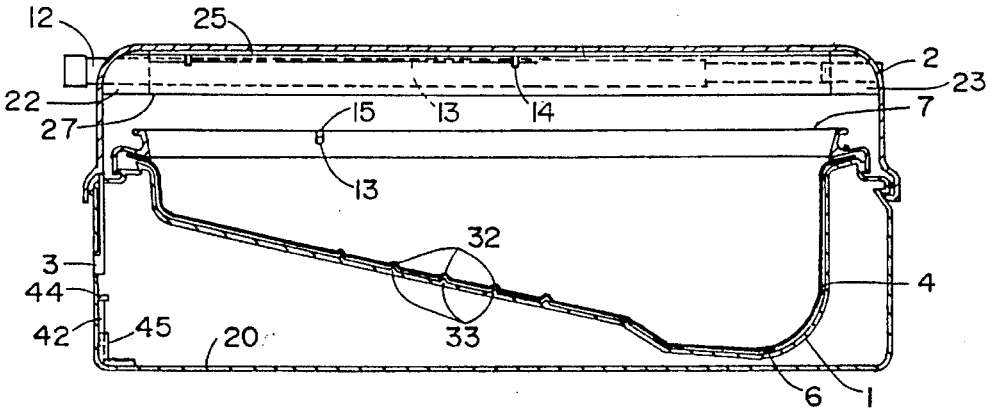
FIG. 4 is a partially sectioned side view of the assembly taken at the cutting plane IV—IV in FIG. 2.

A transverse cutting plane III—III has been taken at the retainer pins 5, which is shown in FIG. 3. A lengthwise cutting plane IV—IV has been taken to the right of the central longitudinal axis as shown in FIG. 4. A cutting plane V—V has been taken through the right hand side through a retainer pin 5. This is only a FIG. 5 partial section to more clearly show the means for rigidly holding the unitary liner package 4 in the tray 1. A cutting plane VI—VI has been taken through the near end of the assembly and gives only a partial section as in FIG. 6 to more clearly indicate how the separable liners in the unitary liner package 4 are extended for ease of grasping and separation. A cutting plane VIII—VIII has been taken through the far end to more clearly indicate as in FIG. 8 how the cover 2 engages the base 20. A cutting plane IX—IX has been taken to the right at the support rod 13 where it engages the overflow dam 7 as shown in partial section in FIG. 9. A cutting plane VII—VII has been taken through the near end snap lock with biased button 3 holding the cover 2 in place as shown in partial section in FIG. 7. Shown in the far corners are dam pour spouts 8 to empty the unitary liner package of the paint or liquid therein if it is no longer required. On the outer surface of the cover 2 at the near end can be seen an extension handle collar 22 and at the far end a threaded extension handle collar 23. Along the central longitudinal axis on the outer surface of the cover 2 is a recess 27 with the carrying handle 12 passing there along. The support rod 13 is shown in place supported by the overflow dam 7 where a tool or implement can be left in the assembly for storage. It is shown in the alternate position held by rod clips 14. Adhesive double tape 6 assists in holding the liner package 4 to the support tray 1.

In FIG. 3 there is shown more detail of the cutting plane III—III. Mounted on the base 20 is a liquid supporting tray 2 which carries a unitary liner package 4 which receives a liquid or paint to be applied to an object. An overflow dam 7 is seated on top of the unitary liner package 4 with support rod 13 placed in recesses in the overflow dam 7. The cover 2 is shown engaging, in an airtight sealing arrangement, the base 20. The cover 2 is strengthened by bracing ribs 25. A depression or recess 27 is formed in the cover 2 with a carrying handle 12 fixed therein. Formed in the far end of cover 2 is the threaded collar 23 which receives the combined alternate carrying or telescopic implement handle 12. Rod clips 14 are attached to the underside of cover 2 to hold a paint can opener 38 and in alternate position the support rod 13. Tray clamp notches 46 are found near the bottom of base 20 to receive tray clamps 39.

Referring now to FIG. 4 there is shown in more detail the section IV—IV of FIG. 2. The base 20 is shown sectioned along its longitudinal axis with the supporting tray 1 integrally joined thereto. Positioned in the tray 1 is a unitary liner package 4 formed as a single unit from several plastic sheets preferably 3–10 mils in thickness. Because of their nesting relationship the top liner has a lesser volumetric capacity than the lower ones. The near end edges are displaced from one another by preforming liner displacement, by angle cutting or various other means to aid in grasping for removal. The package 4 receives and contains the liquid while it is supported in the tray 1. In the central portion of both the liner package 4 and the supporting tray 1 there are washboard ridges 32 and 33 respectively for proper liquid distribution on an applicator such as paint on a paint roller. Between the liner package 4 and support tray 1 are one or more double sided adhesive tapes 6 to hold the package 4 especially as the liners become depleted. Mounted in clamping relationship on top of a portion of the unitary liner package 4 is the overflow dam 7 which has a recess 15 in both sides thereof to receive the support rod 13 which is provided to support a brush, roller or the like when temporarily not in use or when they are to be stored. During the normal use of the assembly the support rod is found supported by clips 14 on the interior of the cover 2. A handle recess 27 formed by an inward recess in the cover 2 has supported therein a handle 12. A plain extension handle collar 22 and a threaded extension handle collar 23 are formed on the interior of cover 2. Mounted in the collars 22 and 23 is the telescopic combined carrying and tool extension handle 12. Also shown is a retractable leg 42 which is shown in detail in FIGS. 14 and 15. These legs are commonly hooked on to a stepladder when painting.

Figure 5:
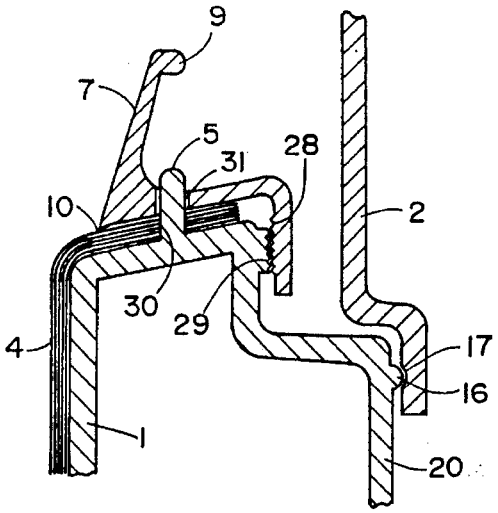
FIG. 5 is a partial vertical section of the tray, dam, liners and air seal taken at the cutting plane V—V in FIG. 2.

FIG. 5 relates to the cutting plane V—V which shows a partial section in detail. There is shown the supporting tray 1 attached or integrally formed with the base 20. The cover 2 is shown making an air tight seal to protect the contents of the assembly. The air tight seal is generally formed by a protrusion 16 on base 20 engaging a recess 17 in cover 2. The reverse location of 16 and 17 is also possible as well as any well known gasket air seal. The supporting tray 1 has extending upwardly therefrom a retainer pin 5 and on a side extension a roughened or undulating surface 29. The supporting tray 1 has placed over it a unitary liner package 4 with apertures 30 which receive the retainer pin 5 for retention and alignment. An overflow dam 7 with dam aperture 31 is placed on a portion of the unitary liner package 4. The dam aperture 31 receives the retain pin 5. To make a good seal between dam 7 and liner package 4 the dam 7 has a dam pressure edge 10. This seal is necessary to prevent liquid or paint from entering damaging locations in the assembly. The dam 7 has a roughened or undulating surface 28 to engage and cooperate with the roughened or undulatng surface 29 to retain the forced down dam 7 in its clamping position on the liner package 4.

Figure 6:
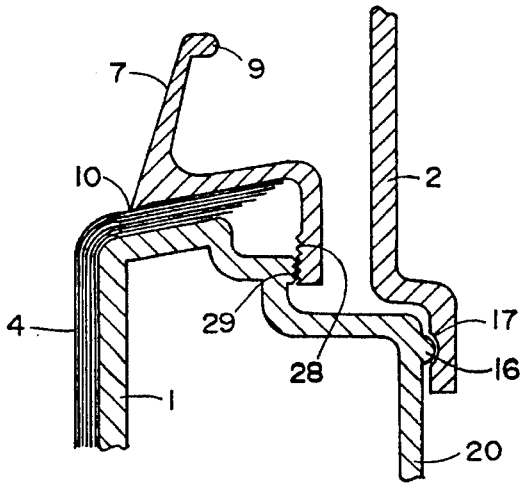
FIG. 6 is a partial vertical section of the tray, dam, liners and air seal taken at the cutting plane VI—VI in FIG. 2.

The FIG. 6 as shown refers to the near end cutting plane V—V which teaches the gradation in length of each of the separate liners of the unitary liner package 4. This feature is important in that it allows for ease of grasping and removal of a used or unwanted liner. In certain circumstances it may be necessary or desirable to resort to the application of tabs for ease of separation of designated liners. The unitary liner package 4 is as previously shown supported on the liquid supporting tray 1 which includes a roughened or undulating surface 29 and is joined to the base 20. The overflow dam is again shown as pressing down or clamping the unitary linen package 4 to the supporting tray 1. The overflow dam 7 has a pressure edge 10 which ensures that no liquid especially a fast drying liquid reaches the edges of the liners to be separated. The overflow dam 7 is held in a clamping relationship by having a roughened or undulating surface 28 cooperating with the roughened or undulating surface 29. A grasping and lifting of dam grasping ledge 9 will remove the overflow dam 7 so that removal of an unwanted liner can be achieved. Further shown in this figure is the cover 2 engaging the base 20 in an air-tight sealing relationship by a protrusion 16 cooperating with a recess 17.

FIG. 7 indicates the partial cross section taken at VII—VII. This is a cross section of a first embodiment of a snap lock at the near end of the container assembly. The base 20, is shown as having an aperture 21 permitting movement and engagement by a button 3. The button 3 is fastened by a flexible biasing elongate appendage 34 to cover 2. The above arrangement provides a snap lock as the cover is forced downward into the air tight sealing position provided by protrusion 16 and recess 17.

Now moving to the far end of the container assembly there is indicated in FIG. 8 the partial cross section VIII—VIII which has a base groove 19 extending transversely thereof for a major portion of the width of the assembly. Engaging the base groove 19 is a cover hook 18 to hold the cover 2 in its air tight position established by air seal protrusion 16 and air seal recess 17.

Figure 9:
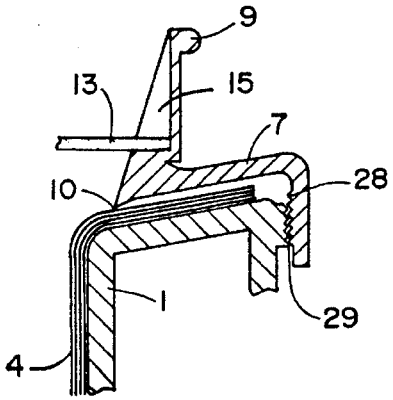
FIG. 9 is a partial vertical section of the dam positioning the implement support rod as taken at the cutting plane IX—IX in FIG. 2.

Referring to FIG. 9 there is shown a partial cross section IX—IX which basically teaches how each end of the support rod 13 is mounted in the recess 15 of the overflow dam 7. The overflow dam 7 is similar to that shown in FIG. 5 with its dam pressure edge 10, its retainer roughened or undulating surface 28 and its grasping ledge 9 to lift and remove it for allowing a used liner to be expiditiously removed. The unitary liner package 4 is similarly held in a compressed and sealed condition by overflow dam 7 and supported by supporting tray 1.

FIG. 10 teaches an alternate snap lock for holding the cover 2 in its air sealed position against base 20. The base 20 has an upright base elongate appendage 35 with snap lock hook 36 inherently biased toward the inside of cover 2 where it engages snap lock groove 37 of cover 2. The elongate appendage 35 could utilize any kind of biasing if it is not inherent in the material. The button 3 is joined to the elongate appendage 35 for disengaging the snap lock for removing the cover 2 from the base 20.

Figure 11:
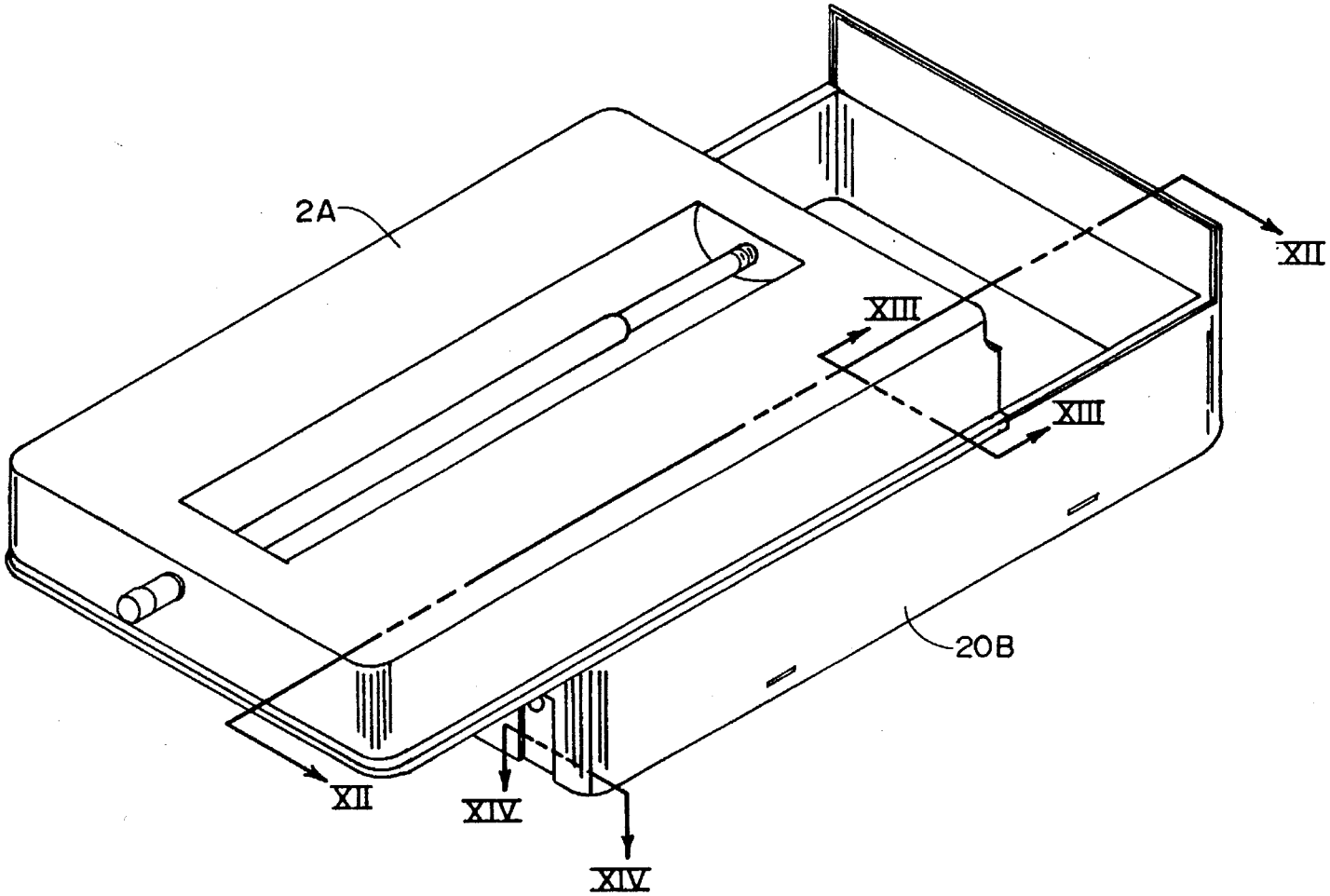
FIG. 11 is a perspective view of modification of the assembly of FIG. 1 without a storage tray. There is shown a new base and new cover slideable relative thereto. The support tray, liner package and dam are not shown as the tray can be mounted on or integrally joined to any base.
Figure 12:
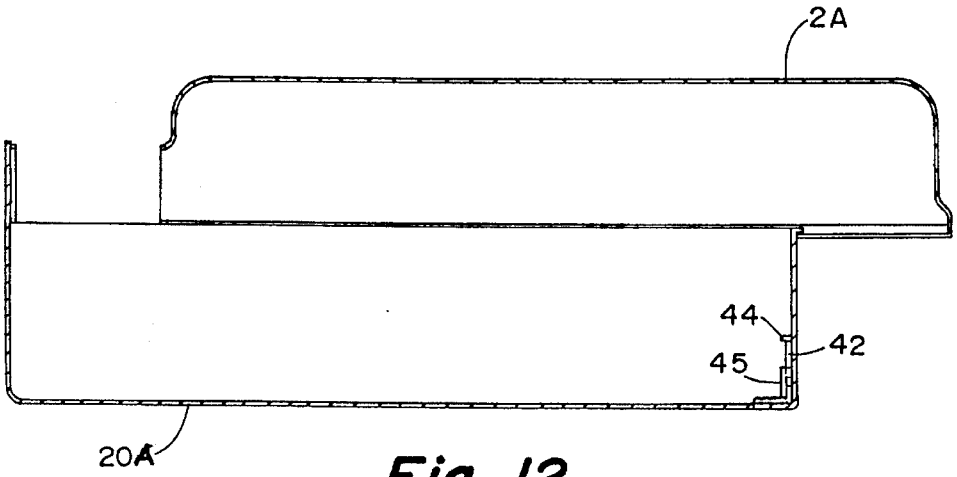
FIG. 12 is a vertical section taken at the cutting plane XII—XII in FIG. 11.

Referring now to FIG. 11 there is here shown a second embodiment in perspective having a base 20A and a cover 2A partially removed by a sliding movement. The base 20A has tray clamp notches 46 near its bottom to receive tray clamps 39 of storage tray 40 (FIG. 1) if desired. The cutting plane XII XII is a cut longitudinally of the base 20A and cover 2A as shown in FIG. 12. The cutting plane XIII XIII is a partial cut showing only the sliding connection been the base 20A and cover 2A as shown in FIG. 13 and the cutting plane XIV XIV is a partial section of a retractable leg 42 and its mounting as shown in FIG. 14.

Referring now to FIG. 12 we have the cut base 20A with the cut cover 2A partially removed by sliding and one of the retractable legs 42 in side elevation with its sliding stop 44 and guide 45 holding the retractable leg 42 in position by friction or the like.

Figure 13:
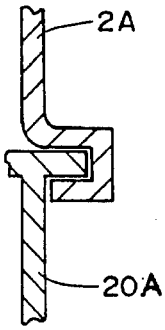
FIG. 13 is a partial vertical section of the cutting plane XIII—XIII in FIG. 11 showing the sliding engagement.

FIG. 13 shows the partial cut XIII XIII indicating the sliding connection between the base 20A.

Figure 14:
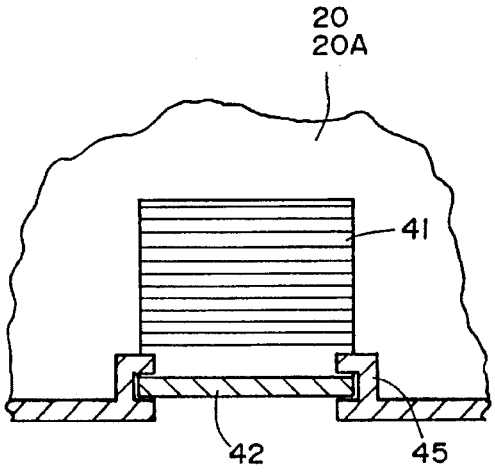
FIG. 14 is a partial plan view section of the cutting plane XIV—XIV showing the retractable leg.

The FIG. 14 is a partial cut indicated by the cutting plane XIV XIV showing that the base can be either 20 or 20A, that the retractable leg 42 is slidably supported in guide 45 and that the retractable leg 42 has roughned or undulating foot 41 to engage a ladder or the like to stabilize the base 20 or 20A when in use.

Figure 15:
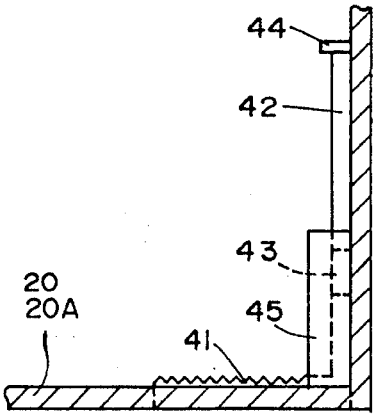
FIG. 15 is a partial vertical section of the cutting plane XII—XII showing a vertical view of the retractable leg of FIG. 14.

Referring now to FIG. 15 there is shown a vertical view of the retractable leg 42 of FIG. 14 or an enlargement of the retractable leg 42 shown in FIG. 12. There is here indicated the retractable 42 with a sliding stop 44 to limit the extension below the base 20 or 20A. The retractable leg 42 is guided in its movement by guide 45. A roughned or undulating foot 41 is formed as an integral part of the retractable leg 42. A finger aperture 43 is provided to enable a person to extend or retract the retractable leg by applying with the finger or other suitable means a force thereto in the vertical direction.

OPERATION

To prepare the container assembly of FIG. 1 for use it is placed on a flat surface such as a table or floor. The cover 2 is removed by depressing release buttons 3 to unlatch the snap lock, lifting and pivoting cover 2 until it is free of the base 20. The supporting tray 1 joined to the base 20 is now exposed. One or more strips of adhesive double tape 6 is placed in the deepest area of the tray 1. A unitary liner package 4 with apertures 30 is placed in the supporting tray 1 where it is aligned and held by the retainer pins 5 and adhesive tape 6. An overflow dam 7 with apertures 31 is placed on top of the peripheral surface of the liner package 4 after alignment by the retainer pins 5 passing through apertures 31. The overflow dam 7 is pressed firmly downwardly so dam pressure edge 10 makes a seal against the liner package 4. The overflow dam 7 is held down by an uneven or roughened surface 28 of the overflow dam 7 engaging an uneven roughened or undulating surface 29 on tray 1. A liquid such as paint can now be poured into the liner package 4 where it is readily accessible by a brush, roller or the like.

When a single liner of the unitary liner package 4 is to be removed the remaining paint is removed by pouring it from one of the two dam pouring spouts 8. A paint brush can be used to clean any excess paint that may be on the dam 7 or dam spout 8. The dam 7 is now grasped at the dam grasping ledge 9 and lifted upwardly to release it from the retainer pins 5. Using the edge of your thumb at the near or shallow end of the tray 1 separate and gradually peel or lift off the used or soiled liner and discard. Clean the underside of the overflow dam 7, replace it in clamping and sealing position and if required for more painting fill the fresh liner with a new supply of paint.

For storage purposes it is best to remove by means of a dam pouring spout 8 most of the remaining paint. A small amount of paint or water should be left in liner package 4 if a brush or roller is to be stored without cleaning. The support rod 13 is now removed from rod clips 14 on the underside of cover 2. The support rod 13 is snapped down into support rod recesses 15 where a paint brush handle or roller handle can be supported thereon. The cover 2 is now applied by placing cover hook 18 into the base groove 19 at the far end then pivoting the cover 2 downwardly until the air seal protrusion 16 and recess 17 engage. Further pressure will cause the snap lock with release buttons 3 to engage making a secure air tight seal. The container assembly can be carried away to storage by the combined telescoping carrying and tool extension handle 12 which is slid through collar 22 and securely threaded in collar 23.

For the second embodiment shown in FIGS. 11, 12 and 13 the only real difference in operation is the cover 2A being removed by a relative sliding between the cover 2A and the container base 20A. A tongue and groove arrangement as shown in FIG. 13 is most commonly used. The supporting tray, liner package and dam (not shown in these figures) is most commonly joined in an integral manner with the base 20A and used in the same manner as with base 20.

Various modifications such as size, shape and arrangement of components may be made without departing from the spirit and scope of this invention. The above disclosure shall be interpreted as illustrative only and limited only by the scope of the invention as defined in the following claims.

What I claim is:

1. A paint tray assembly comprising in combination, a base, a tray supported by said base, a unitary liner package formed of several tray shaped and separately disposable liquid receiving layers seated in said tray, clamping means including a retainer surface adjustably and fixedly holding said clamping means in engagement with a portion of said unitary liner package and said clamping means further including a pressure edge of closed loop shape sealingly engaging a portion of closed loop shape of said unitary liner package.

2. A paint tray assembly as claimed in claim 1 further including penetrating retainer means penetrating said unitary liner package for positioning said unitary liner package in said tray prior to clamping.

3. A paint tray assembly as claimed in claim 1 wherein said clamping means is an overflow dam including a grasping ledge for ease of removal and replacement when removing an unwanted layer of said layers of said unitary liner package.

4. A paint tray assembly as claimed in claim 2 wherein said clamping means is an overflow dam including a grasping ledge for ease of removal and replacement when removing an unwanted layer of said layers of said unitary liner package.

5. A paint tray assembly as claimed in claim 4 wherein said penetrating retainer means includes retainer pins extending from said tray and wherein said tray includes an undulating surface cooperating with said retainer surface for adjusted clamping.

6. A paint tray assembly as claimed in claim 5 wherein said retainer pins also penetrate said overflow dam.

7. A paint tray assembly as claimed in claim 1 further including one or more adhesive portions joining said unitary liner package to said tray.

8. A container assembly for holding and protecting the contents thereof comprising in combination, a base, a tray joined to said base and having a recess for supporting a supply-of liquid, a unitary liner package formed of several adjacent tray shaped and separately disposable liquid retainable layers seated in and supported by said tray, clamping means including clamp retainer means adjustably and fixedly forcing said unitary liner package against said tray, said clamping means further including a sealing portion engaging said unitary liner to prevent egress of said liquid from between said clamping means and said unitary liner package, and an air tight cover engaging said base for protection of the contents including said liquid.

9. A container assembly as claimed in claim 8 wherein said clamping means is an overflow dam including a grasping ledge for ease of removal and replacement when removing one layer of said layers of said unitary liner package.

10. A container assembly as claimed in claim 8 further including penetrating retainer means penetrating said unitary liner package for positioning said unitary liner in said tray prior to clamping.

11. A container assembly as claimed in claim 10 wherein said penetrating retainer means are retainer pins extending upwardly from said tray.

12. A container assembly as claimed in claim 8 wherein said clamping means is an overflow dam, wherein said clamp retainer means includes an undulating dam retainer surface and wherein said tray includes a tray undulating surface engaged by said undulating dam retainer surface.

13. A container assembly as claimed in claim 11 wherein said clamping means includes apertures penetrated by said retainer pins.

14. A container assembly as claimed in claim 12 wherein said overflow dam further includes at least one pour spout for ease of removal of unwanted liquid from said unitary liner package.

15. A container assembly as claimed in claim 14 further including an extension handle mounted on the exterior of said air tight cover and a support rod releasably secured on the interior of said airtight cover.

16. A container assembly as claimed in claim 15 including one or more adhesive portions joining said unitary liner package to said tray.

17. A container assembly as claimed in claim 13 further including, a support rod releasably supported by said clamping means, a storage tray attached to said base and at least one retractable leg slidably mounted in said base.

18. A container assembly as claimed in claim 15 wherein said extension handle is mounted in a recess on the exterior of said air tight cover and wherein said unitary liner package includes washboard ridges in at least a central portion thereof.

19. A container assembly as claimed in claim 8 wherein said air tight cover is removeably held in a protective operating position by at least one cover hook at a first end and at least one snap lock at a second end.

* * * * *